US008820231B2

(12) United States Patent
Choi

(10) Patent No.: US 8,820,231 B2
(45) Date of Patent: Sep. 2, 2014

(54) ROLL-TO-ROLL PRINTING APPARATUS

(71) Applicant: Sung An Machinery Co., Ltd., Gyeonggi-do (KR)

(72) Inventor: Dong Kwon Choi, Gyeonggi-do (KR)

(73) Assignee: Sung An Machinery Co., Ltd., Gyeonggi-Do (KR)

( * ) Notice: Subject to any disclaimer, the term of this patent is extended or adjusted under 35 U.S.C. 154(b) by 0 days.

(21) Appl. No.: 13/780,614

(22) Filed: Feb. 28, 2013

(65) Prior Publication Data

US 2013/0228083 A1 Sep. 5, 2013

(30) Foreign Application Priority Data

Mar. 2, 2012 (KR) ..... 10-2012-0021656

(51) Int. Cl.

| | |
|---|---|
| ***B41L 13/08*** | (2006.01) |
| ***B41F 13/02*** | (2006.01) |
| ***B41J 2/06*** | (2006.01) |
| *B41J 2/01* | (2006.01) |
| *B41J 2/14* | (2006.01) |

(52) U.S. Cl.

CPC . *B41F 13/02* (2013.01); *B41J 2/06* (2013.01); *B41J 2002/012* (2013.01); *B41J 2/14161* (2013.01); *B41J 2002/061* (2013.01)

USPC ..... 101/122; 101/119

(58) Field of Classification Search

CPC ..... B41J 2/14161

USPC ..... 399/122; 101/122

See application file for complete search history.

(56) References Cited

U.S. PATENT DOCUMENTS

| | | | | | |
|---|---|---|---|---|---|
| 3,487,775 | A | * | 1/1970 | Chaney et al. | 101/35 |
| 3,557,690 | A | * | 1/1971 | Voegelin | 101/120 |
| 3,834,301 | A | * | 9/1974 | Croquelois et al. | 347/55 |
| 4,442,771 | A | * | 4/1984 | Mitter | 101/122 |
| 4,729,305 | A | * | 3/1988 | Spencer | 101/35 |
| 5,357,865 | A | * | 10/1994 | Mather | 102/361 |
| 7,500,743 | B2 | * | 3/2009 | Takashima | 347/100 |

FOREIGN PATENT DOCUMENTS

| | | |
|---|---|---|
| KR | 1020090101738 | 9/2009 |
| KR | 1020110137494 | 12/2011 |

* cited by examiner

*Primary Examiner* — Anthony Nguyen

(74) *Attorney, Agent, or Firm* — Nixon Peabody LLP; David S. Resnick; David F. Crosby

(57) ABSTRACT

Disclosed is a roll-to-roll printing apparatus, which includes n support rollers arranged in an n-gonal shape (where n is an integer equal to or greater than 3), a looped pattern mask having a plurality of pattern sections passing through inner and outer surfaces thereof and disposed so as to interconnect the support rollers, a driver that rotates the pattern mask, a transfer unit having an unwinder and a rewinder of a printing target and a backup roller that is disposed between two of the support rollers adjacent to each other and outside the pattern mask and that supports the printing target transferred from the unwinder to the rewinder, a printing unit disposed inside the pattern mask and discharging ink toward the printing target supported on the backup roller, and a tension adjusting unit adjusting tension of the pattern mask.

3 Claims, 4 Drawing Sheets

ROLL-TO-ROLL PRINTING APPARATUS

CROSS-REFERENCE TO RELATED APPLICATION

This application is based upon and claims the benefit of priority from Korean Patent Application No. 2012-0021656, filed on Mar. 2, 2012, the entire contents of which are incorporated herein by reference.

BACKGROUND OF THE INVENTION

1. Field of the Invention

The present invention relates to a roll-to-roll printing apparatus capable of adjusting tension of a pattern mask so as to allow precision of a print pattern to be improved.

2. Description of the Related Art

Conventionally, there is a proposal for a roll-to-roll printing apparatus, which includes a chamber formed in a body in order to contain a predetermined amount of fluid, a body having nozzles that communicate with the chamber to spray the fluid and that are formed on one side of the body, and a printing roller unit having a plurality of droplet spraying inkjet heads which are arranged on an outer circumferential surface thereof, and each of which includes an actuator forming an electrostatic field so that the fluid is sprayed through the nozzles.

The roll-to-roll printing apparatus includes arbitrary first-row nozzle parts arranged along a central axis of the printing roller unit at regular intervals, and arbitrary second-row nozzle parts located adjacent to the first-row nozzle parts and arranged along the central axis of the printing roller unit at regular intervals. The nozzles constituting the second-row nozzle parts are alternately arranged between the nozzles constituting the first-row nozzle parts. With this configuration, the roll-to-roll printing apparatus can provide a print having a very small size such as a micron size, and improve resolution, integration, and precision of the print.

SUMMARY OF THE INVENTION

In the related art, the plurality of nozzle parts are arranged on the outer circumferential surface of the printing roller unit, and a micro inkjet based on electrostatic field induction is realized, thereby forming a fine pattern. Since the plurality of nozzle parts are provided for the printing roller unit, it is difficult to manufacture the roll-to-roll printing apparatus. Even if possible, the roll-to-roll printing apparatus is costly.

Accordingly, the present invention has been made keeping in mind the above problems occurring in the related art, and an object of the present invention is to provide a roll-to-roll printing apparatus capable of adjusting tension of a pattern mask so as to allow precision of a print pattern to be improved.

To achieve the aforementioned object, there is provided a roll-to-roll printing apparatus, which includes n support rollers arranged in an n-gonal shape (where n is an integer equal to or greater than 3), a looped pattern mask having a plurality of pattern sections passing through inner and outer surfaces thereof and disposed so as to interconnect the support rollers, a driver that rotates the pattern mask, a transfer unit having an unwinder and a rewinder of a printing target and a backup roller that is disposed between two of the support rollers adjacent to each other and outside the pattern mask and that supports the printing target transferred from the unwinder to the rewinder, a printing unit disposed inside the pattern mask and discharging ink toward the printing target supported on the backup roller, and a tension adjusting unit adjusting tension of the pattern mask.

According to a feature of the present invention, the tension adjusting means may include a load cell connected to one of the support rollers, a displacing means for displacing the support roller to which the load cell is connected in an inward or outward direction of the pattern mask, and a controller operating the displacing means based on a measured value of the load cell and controlling a position of the support roller to which the load cell is connected.

According to another feature of the present invention, the tension adjusting means may include a pressing roller that is in contact with an outer surface of the pattern mask and that is disposed between two of the support rollers adjacent to each other, a load cell that is connected to the pressing roller, a displacing means that displaces the pressing roller in an inward or outward direction of the pattern mask, and a controller that operates the displacing means based on a measured value of the load cell and that controls a position of the pressing roller.

According to yet another feature of the present invention, the printing unit may include: a body that has a first segment provided with an internal cavity and an upper injection part for feeding the ink into the cavity, and a second segment coupled to the first segment and covering the cavity; a first shim plate that is interposed between the segments of the body and that has a downwardly opened discharge part formed at a part or all of a region opposite to the cavity of the first segment; and a second shim plate that has a screen part interposed between the first shim plate and the second segment and covering one side of the discharge part of the first shim plate, and a squeeze part extending downward from the screen part and pressing the pattern mask toward the backup roller.

According to the roll-to-roll printing apparatus of the present invention, the printing unit disposed inside the pattern mask forms a print pattern on the printing target using the pattern sections formed in the pattern mask. Here, the pattern mask maintains constant tension due to the tension adjusting means, so that the print pattern can be formed on the printing target with precision.

Further, the pattern mask surrounds the support roller in a polygonal shape, so that the pattern mask can be easily manufactured and replaced.

BRIEF DESCRIPTION OF THE DRAWINGS

The above and other objectives, features and advantages of the present invention will be more clearly understood from the following detailed description when taken in conjunction with the accompanying drawings, in which.

DESCRIPTION OF THE PREFERRED EMBODIMENTS

Reference will now be made in greater detail to an embodiment of the present invention with reference to the accompanying drawings.

Figure 1:
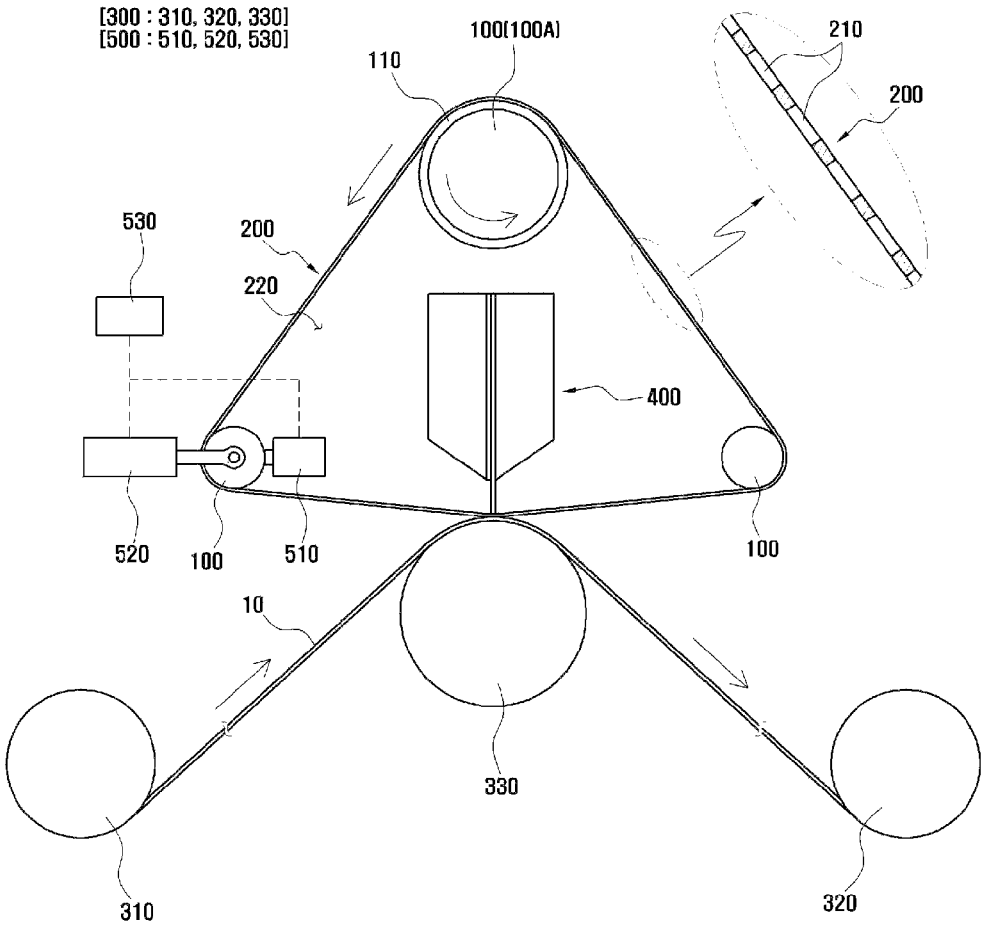
FIG. 1 is a schematic view showing a roll-to-roll printing apparatus according to an embodiment of the present invention.
Figure 2:
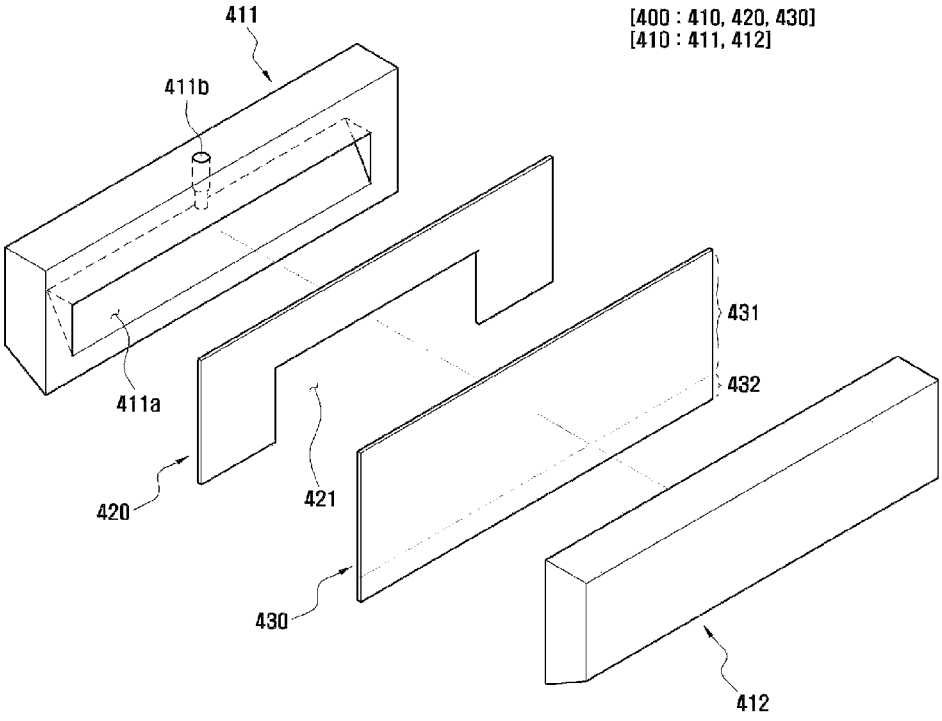
FIG. 2 is an exploded perspective view of the printing unit shown in FIG. 1.
Figure 3:
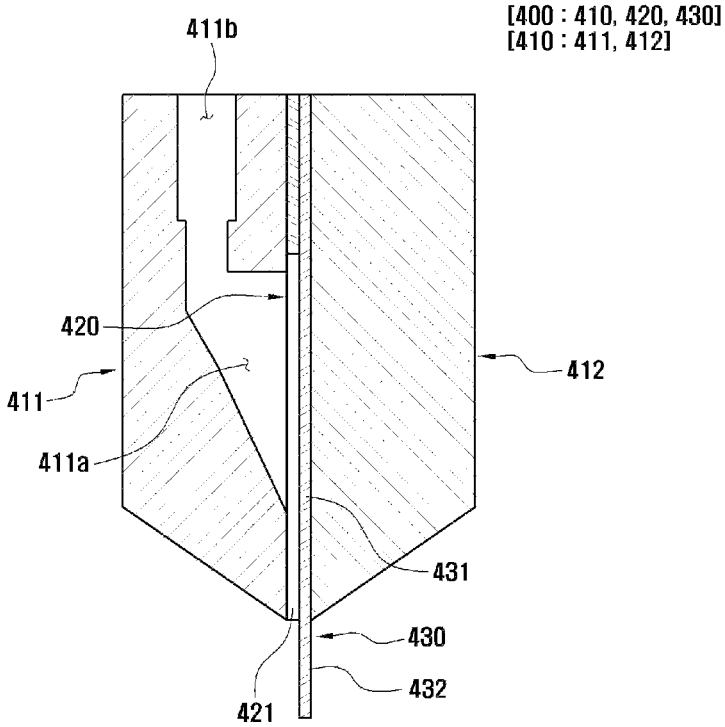
FIG. 3 is a cross-sectional view of the printing unit shown in FIG. 1.

As shown in FIGS. 1 to 3, a roll-to-roll printing apparatus according to an embodiment of the present invention generally includes support rollers 100, a pattern mask 200, a transfer unit 300, a printing unit 400 and a tension adjusting means 500.

As for each component, as shown in FIG. 1, the three support rollers 100 are arranged in a triangular shape.

As shown in FIG. 1, the pattern mask 200 is formed in a loop shape, has a plurality of pattern sections 210 passing through inner and outer surfaces thereof, and is disposed so as to surround the support rollers 100.

Thus, the pattern mask 200 is supported on the support rollers 100 in a triangular shape. Thereby, a housing space 220 in which the printing unit 400 is disposed is defined inside the pattern mask 200.

Consequently, the support rollers 100 serve to support the pattern mask 200. Thus, the support rollers 100 may be arranged in various shapes such as a quadrilateral shape, a pentagonal shape, a hexagonal shape, etc. in addition to the triangular shape so as to allow the housing space 220 to be defined inside the pattern mask 200 as long as it supports the pattern mask 200.

That is, the number of support rollers 100 is n (where n is an integer equal to or greater than 3), and may be arranged so as to form an n-gonal shape.

The pattern mask 200 may be manufactured by forming the pattern sections 210 in a long metal sheet formed of stainless steel, invar, or nickel by etching or laser processing, and connecting opposite ends of the sheet.

The pattern mask 200 has a thickness from about 20 microns to about 100 microns depending on a thickness of a pattern to be printed.

Meanwhile, any one of the support rollers 100 is connected with a driver (not shown) for rotating the pattern mask 200.

In the present embodiment, the driver is connected to the support roller 100 disposed on an upper side among the three support rollers 100. Hereinafter, the support roller 100 to which the driver is connected is referred to as a driving roller 100A.

The driver is made up of a motor, and rotates the driving roller 100A. The pattern mask 200 circulates by the rotation of the driving roller 100A.

As shown in FIG. 1, the driving roller 100A may have a greater diameter than the two other support rollers 100. As a result, a contact area of the driving roller 100A with the pattern mask 200 is increased to enable smooth rotation of the pattern mask 200.

A rubber roll 110 is fitted on an outer circumferential surface of the driving roller 100A. Here, the outer circumferential surface of the driving roller 100A may be formed with a diamond-like carbon (DLC) coating layer for smooth rotation and high durability of the pattern mask 200.

The transfer unit 300 functions to transfer a printing target 10. As shown in FIG. 1, the transfer unit 300 includes an unwinder 310 and a rewinder 320 of the printing target 10, and a backup roller 330 that is disposed between the two neighboring support rollers 100 and outside the pattern mask 200 and that supports the printing target 10 transferred from the unwinder 310 to the rewinder 320.

Here, the printing target 10 has a flexible substrate having a web shape, and is transferred from the unwinder 310 to the rewinder 320.

The printing unit 400 is disposed inside the pattern mask 200, and discharges ink toward the printing target 10 supported on the backup roller 330. As shown in FIGS. 2 and 3, the printing unit 400 includes a body 410 that is made up of a first segment 411 provided with an internal cavity 411*a* and an upper injection part 411*b* for feeding the ink into the cavity 411*a* and a second segment 412 coupled to the first segment 411 and covering the cavity 411*a*, a first shim plate 420 that is interposed between the segments 411 and 412 of the body 410 and that has a downwardly opened discharge part 421 formed at a part or all of a region opposite to the cavity 411*a* of the first segment 411, and a second shim plate 430 that has a screen part 431 interposed between the first shim plate 420 and the second segment 412 and covering one side of the discharge part 421 of the first shim plate 420 and a squeeze part 432 extending downward from the screen part 431 and pressing the pattern mask 200 toward the backup roller 330.

Here, the injection part 411*b* of the first segment 411 is connected with an ink feeder provided separately. Thus, the ink fed from the ink feeder is fed to the cavity 411*a* through the injection part 411*b*.

Each of the first and second shim plates 420 and 430 is formed of a sheet having a thickness from about 50 microns to about 100 microns and formed of a material such as stainless steel, nickel or polymer.

The discharge part 421 of the first shim plate 420 communicates with the cavity 411*a* of the first segment 411. Thus, the discharge part 421 provides a discharge passage so that the ink fed to the cavity 411*a* can be discharged to the body 410 in a downward direction.

The squeeze part 432 of the second shim plate 430 presses the pattern mask 200, thereby bringing the pattern mask 200 into contact with the printing target 10. Thus, the ink discharged through the discharge part 421 of the first shim plate 420 is guided to the printing target 10.

As a result, the printing unit 400 is disposed in the housing space 220, and discharges the ink to the printing target 10 through the pattern sections 210 formed in the pattern mask 200, thereby forming a print pattern on the printing target 10. Here, the squeeze part 432 of the second shim plate 430 presses the pattern mask 200, and causes the pattern mask 200 to come into contact with the printing target 10. In this way, the print pattern can be formed on the printing target 10 with higher precision.

If necessary, the printing unit 400 may be provided with an elevating means for adjusting a vertical position and an angle adjusting means for adjusting an angle to the printing target 10 supported on the backup roller 330.

The tension adjusting means 500 adjusts tension of the pattern mask 200 in a transfer direction of the printing target 10. As shown in FIG. 1, the tension adjusting means 500 includes a load cell 510 connected to one of the support rollers 100, a displacing means 520 for displacing the support roller 100 to which the load cell 510 is connected in an inward or outward direction of the pattern mask 200, and a controller 530 operating the displacing means 520 based on a measured value of the load cell 510 and controlling a position of the support roller 100 to which the load cell 510 is connected.

Here, the displacing means 520 may include a variety of known devices such as a cylinder, or a combination of a motor and a ball screw, which enables linear motion of a target to be displaced.

As a result, the tension adjusting means 500 compares a reference value preset according to requirements of the pattern mask 200, the printing target 10, and the print pattern to be formed on the printing target 10 with the measured value of the load cell 510, and controls the position of the support roller 100 so that the measured value can approach the reference value.

Thus, the pattern mask 200 can maintain constant tension, so that the precision of the print pattern formed on the printing target 10 can be improved.

Figure 4:
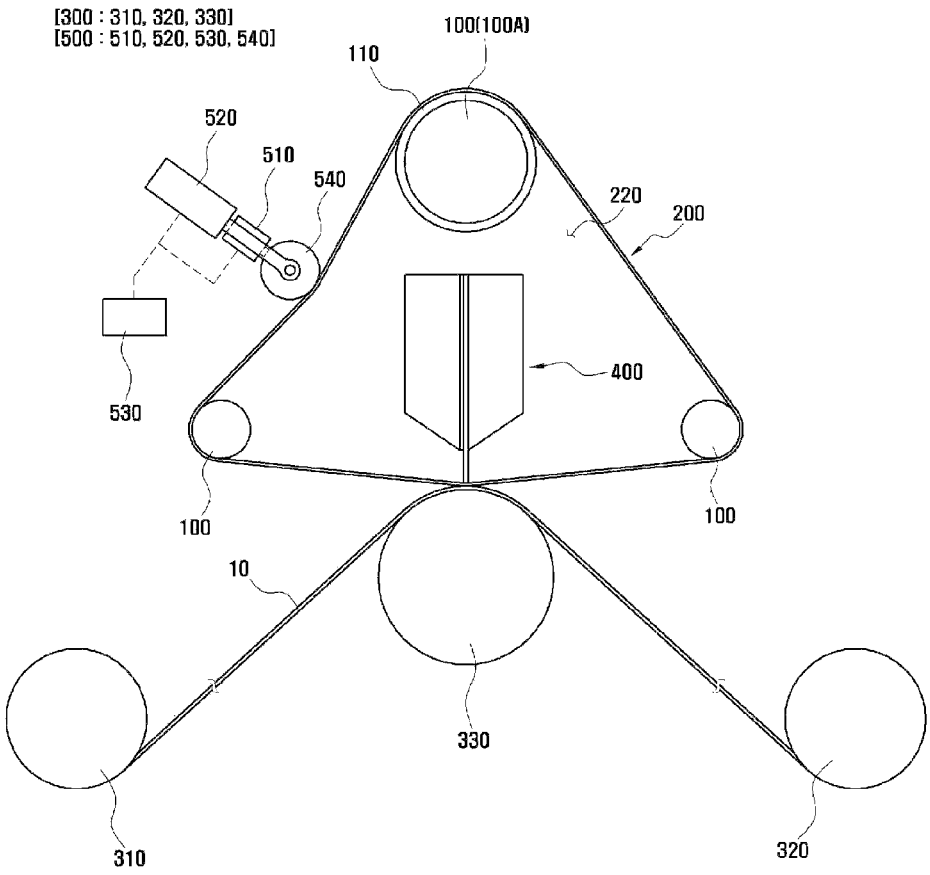
FIG. 4 is a schematic view showing a roll-to-roll printing apparatus according to another embodiment of the present invention.

Meanwhile, as shown in FIG. 4, another tension adjusting means 500 includes a pressing roller 540 that is in contact with an outer surface of the pattern mask 200 and that is disposed between two of the support rollers 100 adjacent to each other, a load cell 510 that is connected to the pressing roller 540, a displacing means 520 that displaces the pressing roller 540 in an inward or outward direction of the pattern mask 200, and a controller 530 that operates the displacing means 520 based on a measured value of the load cell 510 and that controls a position of the pressing roller 540.

In detail, the tension adjusting means 500 as shown in FIG. 4 presses the pattern mask 200 from the outside to the inside of the pattern mask 200, and adjusts a pressing force, thereby adjusting the tension of the pattern mask 200.

The tension adjusting means 500 may be subjected to various alternations and modifications within a range within which the tension of the pattern mask 200 is adjusted by pulling the pattern mask 200 in an outward direction or pressing the pattern mask 200 in an inward direction.

Although the roll-to-roll printing apparatus having a specific shape and structure has been mainly described, those skilled in the art will appreciate that various modifications, additions and substitutions are possible, without departing from the scope and spirit of the invention as disclosed in the accompanying claims.

What is claimed is:

1. A roll-to-roll printing apparatus comprising:

at least three support rollers arranged in a polygonal shape;

a looped pattern mask having a plurality of pattern sections passing through inner and outer surfaces thereof and disposed so as to interconnect the support rollers;

a driver rotating the pattern mask;

a transfer unit having an unwinder and a rewinder of a printing target and a backup roller that is disposed between the two support rollers adjacent to each other and outside the pattern mask and supports the printing target transferred from the unwinder to the rewinder;

a printing unit disposed inside a loop formed by the looped pattern mask and discharging ink toward the printing target supported on the backup roller; and a tension adjusting means adjusting tension of the pattern mask, wherein the printing unit includes: a body that has a first segment provided with an internal cavity and an upper injection part for feeding the ink into the cavity, and a second segment coupled to the first segment and covering the cavity; a first shim plate that is interposed between the segments of the body and that has a downwardly opened discharge part formed at a part or all of a region opposite to the cavity of the first segment; and a second shim plate that has a screen part interposed between the first shim plate and the second segment and covering one side of the discharge part of the first shim plate, and a squeeze part extending downward from the screen part and pressing the pattern mask toward the backup roller.

2. The roll-to-roll printing apparatus set forth in claim 1, wherein the tension adjusting means includes:

a load cell connected to one of the support rollers;

a displacing means for displacing the support roller to which the load cell is connected in an inward or outward direction of the pattern mask; and a controller operating the displacing means based on a measured value of the load cell and controlling a position of the support roller to which the load cell is connected.

3. The roll-to-roll printing apparatus set forth in claim 1, wherein the tension adjusting means includes:

a pressing roller that is in contact with an outer surface of the pattern mask and that is disposed between two of the support rollers adjacent to each other;

a load cell that is connected to the pressing roller;

a displacing means that displaces the pressing roller in an inward or outward direction of the pattern mask; and a controller that operates the displacing means based on a measured value of the load cell and that controls a position of the pressing roller.

* * * * *